US010724377B2

(12) United States Patent
Lumpkin et al.

(10) Patent No.: US 10,724,377 B2
(45) Date of Patent: Jul. 28, 2020

(54) ARTICLE OF MANUFACTURE FOR TURBOMACHINE

(71) Applicant: General Electric Company, Schenectady, NY (US)

(72) Inventors: Jamie Dean Lumpkin, Fountain Inn, SC (US); Thomas Robbins Tipton, Greer, SC (US); Kelvin Rono Aaron, Simpsonville, SC (US)

(73) Assignee: General Electric Company, Schnectady, NY (US)

( * ) Notice: Subject to any disclaimer, the term of this patent is extended or adjusted under 35 U.S.C. 154(b) by 363 days.

(21) Appl. No.: 15/188,157

(22) Filed: Jun. 21, 2016

(65) Prior Publication Data

US 2016/0298461 A1 Oct. 13, 2016

Related U.S. Application Data

(63) Continuation of application No. 13/556,313, filed on Jul. 24, 2012, now abandoned.

(51) Int. Cl.

| | |
|---|---|
| ***F01D 5/14*** | (2006.01) |
| ***F01D 9/00*** | (2006.01) |
| ***F01D 25/00*** | (2006.01) |
| ***F01D 5/28*** | (2006.01) |
| ***F01D 5/06*** | (2006.01) |

(Continued)

(52) U.S. Cl.

CPC ..... *F01D 5/141* (2013.01); *F01D 5/06* (2013.01); *F01D 5/28* (2013.01); *F01D 5/3007* (2013.01); *F01D 9/00* (2013.01); *F01D 25/002* (2013.01); *F01D 25/005* (2013.01); *F01D 25/007* (2013.01); *F04D 19/02* (2013.01); *F04D 29/322* (2013.01); *F04D 29/324* (2013.01); *F05D 2220/31* (2013.01); *F05D 2220/32* (2013.01); *F05D 2240/301* (2013.01)

(58) Field of Classification Search

CPC ..... F01D 5/3007; F01D 5/141; F01D 5/06
See application file for complete search history.

(56) References Cited

U.S. PATENT DOCUMENTS 5,197,856 A * 3/1993 Koertge ..... F01D 25/246 415/199.4
7,507,075 B2 * 3/2009 Kang ..... F01D 5/147 416/248

(Continued)

*Primary Examiner* — Woody A Lee, Jr.
*Assistant Examiner* — Michael L Sehn
(74) *Attorney, Agent, or Firm* — Fletcher Yoder, P.C.

(57) ABSTRACT

An article of manufacture includes a rotor blade configured for use with a turbomachine. The blade is configured for attachment to a rotor wheel. The blade is configured to substantially reduce the possibility of attachment with an undesired rotor wheel by modification of at least one characteristic of the blade, so that the modification of the characteristic is matched by a complementary characteristic of the rotor wheel. The characteristic of the blade is, neck width, platform length, platform angle, platform height, tang height, or circumferential width. The blade and the wheel comprise a first stage of the turbomachine. The undesired rotor wheel is in a second stage of the turbomachine, where the first stage is different from the second stage. The complementary characteristic of the wheel is, slot opening width, platform opening depth, slot neck width, slot neck angle, slot tang depth, or slot tang width.

22 Claims, 8 Drawing Sheets

(51) Int. Cl.

| | |
|---|---|
| ***F01D 5/30*** | (2006.01) |
| ***F04D 19/02*** | (2006.01) |
| ***F04D 29/32*** | (2006.01) |

(56) References Cited

U.S. PATENT DOCUMENTS

| | | | | |
|---|---|---|---|---|
| 7,918,644 | B2 * | 4/2011 | Schreiber | F01D 5/06 415/199.5 |
| 2010/0068050 | A1 * | 3/2010 | Hansen | F01D 9/042 415/209.3 |
| 2010/0098547 | A1 * | 4/2010 | Hagan | F01D 5/3007 416/219 R |
| 2011/0052371 | A1 * | 3/2011 | Aschenbruck | F01D 5/06 415/66 |

* cited by examiner

ARTICLE OF MANUFACTURE FOR TURBOMACHINE

CROSS-REFERENCE TO RELATED APPLICATIONS

This application is a continuation of application Ser. No. 13/556,313, filed Jul. 24, 2012, hereby incorporated by reference.

BACKGROUND OF THE INVENTION

The present invention relates generally to turbomachinery, and more particularly relates to an article of manufacture configured for use with turbomachines.

During initial assembly of turbomachine components, or subsequent repair and replacement of turbomachine components, a large number of components must be installed in specific locations of the turbomachine. For example, a stage one rotor blade must be installed in the correct position on a stage one rotor wheel. A typical turbomachine may have many stages with many corresponding components, so a high probability exists that a component for a specific stage may get installed in an incorrect stage (e.g., a stage five rotor blade might get installed in a stage six rotor wheel). The negative implications of this event lead to machine malfunction or inefficiency and increase outage or construction time due to the need to remove and correctly install the specific components.

BRIEF DESCRIPTION OF THE INVENTION

According to one aspect of the present invention, an article of manufacture includes a rotor blade configured for use with a turbomachine. The rotor blade is configured for attachment to a rotor wheel. The rotor blade is configured to substantially reduce the possibility of attachment with an undesired rotor wheel by modification of at least one characteristic of the rotor blade, so that the modification of the characteristic is matched by a complementary characteristic of the rotor wheel. The characteristic of the rotor blade may be at least one of, neck width, platform length, platform angle, platform height, tang height, and circumferential width. The turbomachine may be a compressor or a turbine. The rotor blade and the rotor wheel comprise a first stage of the compressor or turbine. The undesired rotor wheel is in a second stage of the compressor/turbine, where the first stage is different from (or not the same as) the second stage. The complementary characteristic of the rotor wheel may be at least one of, slot opening width, platform opening depth, slot neck width, slot neck angle, slot tang depth, and slot tang width.

According to another aspect of the present invention, an article of manufacture is a rotor wheel configured for use with a turbomachine. The rotor wheel is configured for attachment to a rotor blade. The rotor wheel is configured to substantially reduce the possibility of attachment with an undesired rotor blade by modification of at least one characteristic of the rotor wheel. The modification of the characteristic is matched by a complementary characteristic of the rotor blade. The characteristic of the rotor wheel is slot opening width, platform opening depth, slot neck width, slot neck angle, slot tang depth, or slot tang width.

These and other features and improvements of the present invention should become apparent to one of ordinary skill in the art upon review of the following detailed description when taken in conjunction with the several drawings and the appended claims.

DETAILED DESCRIPTION OF THE INVENTION

One or more specific aspects/embodiments of the present invention will be described below. In an effort to provide a concise description of these aspects/embodiments, all features of an actual implementation may not be described in the specification. It should be appreciated that in the development of any such actual implementation, as in any engineering or design project, numerous implementation-specific decisions must be made to achieve the developers' specific goals, such as compliance with machine-related, system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," and "the" are intended to mean that there are one or more of the elements. The terms "comprising," "including," and "having" are intended to be inclusive and mean that there may be additional elements other than the listed elements. Any examples of characteristics are not exclusive of other characteristics of the disclosed embodiments. Additionally, it should be understood that references to "one embodiment", "one aspect" or "an embodiment" or "an aspect" of the present invention are not intended to be interpreted as excluding the existence of additional embodiments or aspects that also incorporate the recited features. A turbomachine is defined as a machine that transfers energy between a rotor and a fluid or vice-versa, including but not limited to gas turbines, steam turbines and compressors.

Figure 1:
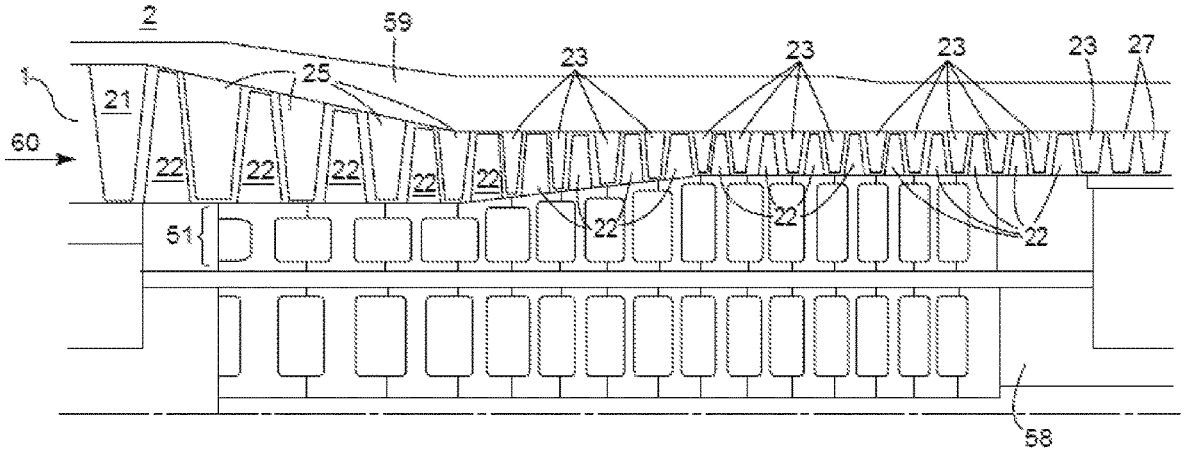
FIG. 1 is a schematic representation of a compressor flow path through multiple stages and illustrates exemplary compressor stages according to an aspect of the invention.

Referring now to the drawings, FIG. 1 illustrates an axial compressor flow path 1 of a compressor 2 that includes a plurality of compressor stages. The compressor 2 may be used in conjunction with, or as part of, a gas turbine. As one non-limiting example only, the compressor flow path 1 may comprise about eighteen rotor/stator stages. However, the exact number of rotor and stator stages is a choice of engineering design, and may be more or less than the illustrated eighteen stages. It is to be understood that any number of rotor and stator stages can be provided in the compressor, as embodied by the invention. The eighteen stages are merely exemplary of one turbine/compressor design, and are not intended to limit the invention in any manner.

The compressor rotor blades 22 impart kinetic energy to the airflow and therefore bring about a desired pressure rise. Directly following the rotor blades 22 is a stage of stator vanes 23. However, in some designs the stator vanes may precede the rotor blades. Both the rotor blades and stator vanes turn the airflow, slow the airflow velocity (in the respective airfoil frame of reference), and yield a rise in the static pressure of the airflow. Typically, multiple rows of rotor/stator stages are arranged in axial flow compressors to achieve a desired discharge to inlet pressure ratio. Each rotor blade and stator vane includes an airfoil, and these airfoils can be secured to rotor wheels or a stator case by an appropriate attachment configuration, often known as a "root," "base" or "dovetail". In addition, compressors may also include inlet guide vanes (IGVs) 21, variable stator vanes (VSVs) 25 and exit or exhaust guide vanes (EGVs) 27. All of these blades and vanes have airfoils that act on the medium (e.g., air) passing through the compressor flow path 1.

Exemplary stages of the compressor 2 are illustrated in FIG. 1. One stage of the compressor 2 comprises a plurality of circumferentially spaced rotor blades 22 mounted on a rotor wheel 51 and a plurality of circumferentially spaced stator vanes 23 attached to a static compressor case 59. Each of the rotor wheels 51 may be attached to an aft drive shaft 58, which may be connected to the turbine section of the engine. The rotor blades and stator vanes lie in the flow path 1 of the compressor 2. The direction of airflow through the compressor flow path 1, as embodied by the invention, is indicated by the arrow 60 (FIG. 1), and flows generally from left to right in the illustration.

The rotor blades 22 and stator vanes 23 herein of the compressor 2 are merely exemplary of the stages of the compressor 2 within the scope of the invention. In addition, each inlet guide vane 21, rotor blade 22, stator vane 23, variable stator vane 25 and exit guide vane 27 may be considered an article of manufacture. Further, the article of manufacture may comprise a rotor blade and/or a rotor wheel configured for use with a compressor.

Figure 2:
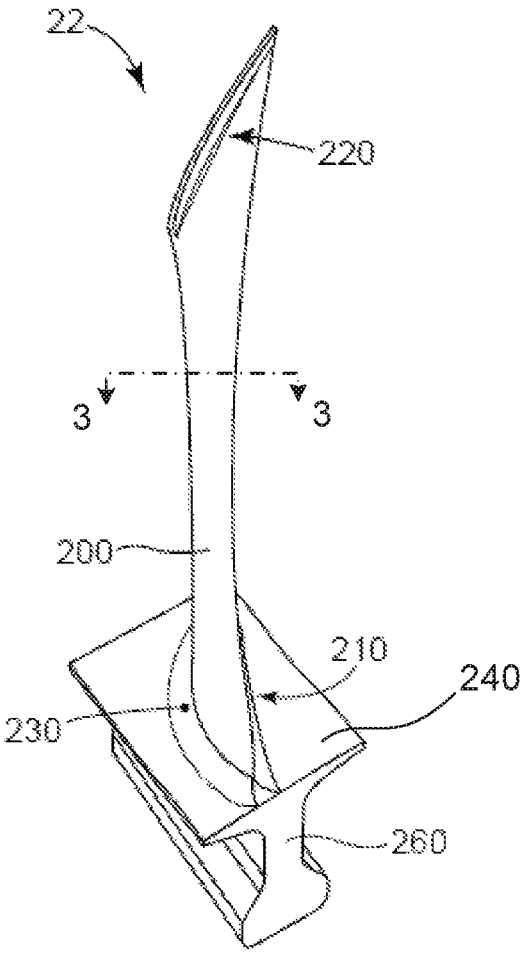
FIG. 2 is a perspective view of a rotor blade, according to an aspect of the invention.

A rotor blade 22, illustrated in FIG. 2, is provided with an airfoil 200. Each of the rotor blades 22 has an airfoil profile at any cross-section from the airfoil root 210 to the airfoil tip 220. The airfoil connects to a mounting base 260, which may also be referred to as a dovetail. The mounting base 260 fits into a complementary shaped groove or slot in the rotor or rotor wheel 51. A fillet 230 may be placed between the airfoil 200 and platform 240. Embodiments of the compressor may incorporate a variety of blades 22 and vanes 21, 23, 25, 27 arranged in multiple stages.

Figure 3:
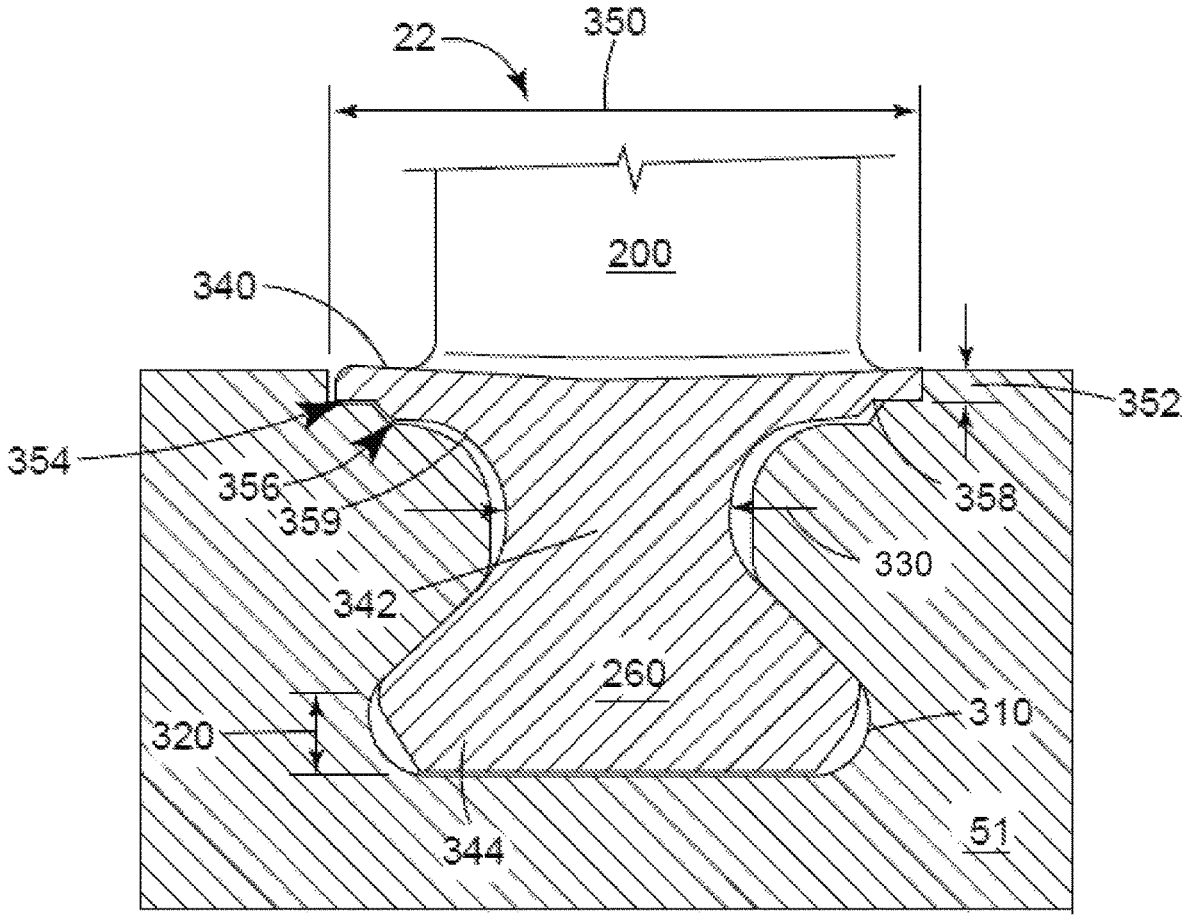
FIG. 3 is a cross-sectional view of a rotor blade mounting base and wheel slot, according to an aspect of the invention.

FIG. 3 illustrates a partial cross-sectional view of the rotor blade 22 mounted in a slot of the rotor wheel 51. The mounting base 260 is shown positioned inside slot 310 of rotor wheel 51. The rotor blade 22 and/or the rotor wheel 51 may be considered an article of manufacture. A portion of airfoil 200 is shown extending radially up out of slot 310. In an aspect of the present invention, the rotor blade 22 is selectively configured for attachment to the rotor wheel 51 and slot 310, so that the rotor blade 22 is configured to substantially reduce the possibility of attachment with an undesired slot (e.g., a third component) in a different stage rotor wheel. This is accomplished by modification of at least one characteristic of the rotor blade 22, so that the modification of the characteristic is matched by a complementary characteristic in the rotor wheel 51 (or slot 310).

The mounting base 260 includes platform 340, neck 342 and tang 344, which all have variable characteristics. The tang 344 is located at the bottom of the rotor blade 22, and has a tang height 320. The tang height may be the vertical (or radial) distance from the bottom of the blade to the widest portion of the tang. The neck 342 has a neck width 330 that may be measured from each axial edge of the neck (or from the left edge to the right edge as shown in FIG. 3). The platform 340 has a platform length 350 that may be measured from each axial edge of the platform 340 (or from the left edge to the right edge as shown in FIG. 3). The platform 340 also has a platform height 352 which may be measured in the radial direction, a platform edge 354, a platform cusp 356 and one or more platform angles 358 and 359. For example, a first platform angle 358 may transition between the platform edge 354 and the platform cusp 356, and a second platform angle 359 may transition between the platform cusp 356 and the neck 342.

Figure 4:
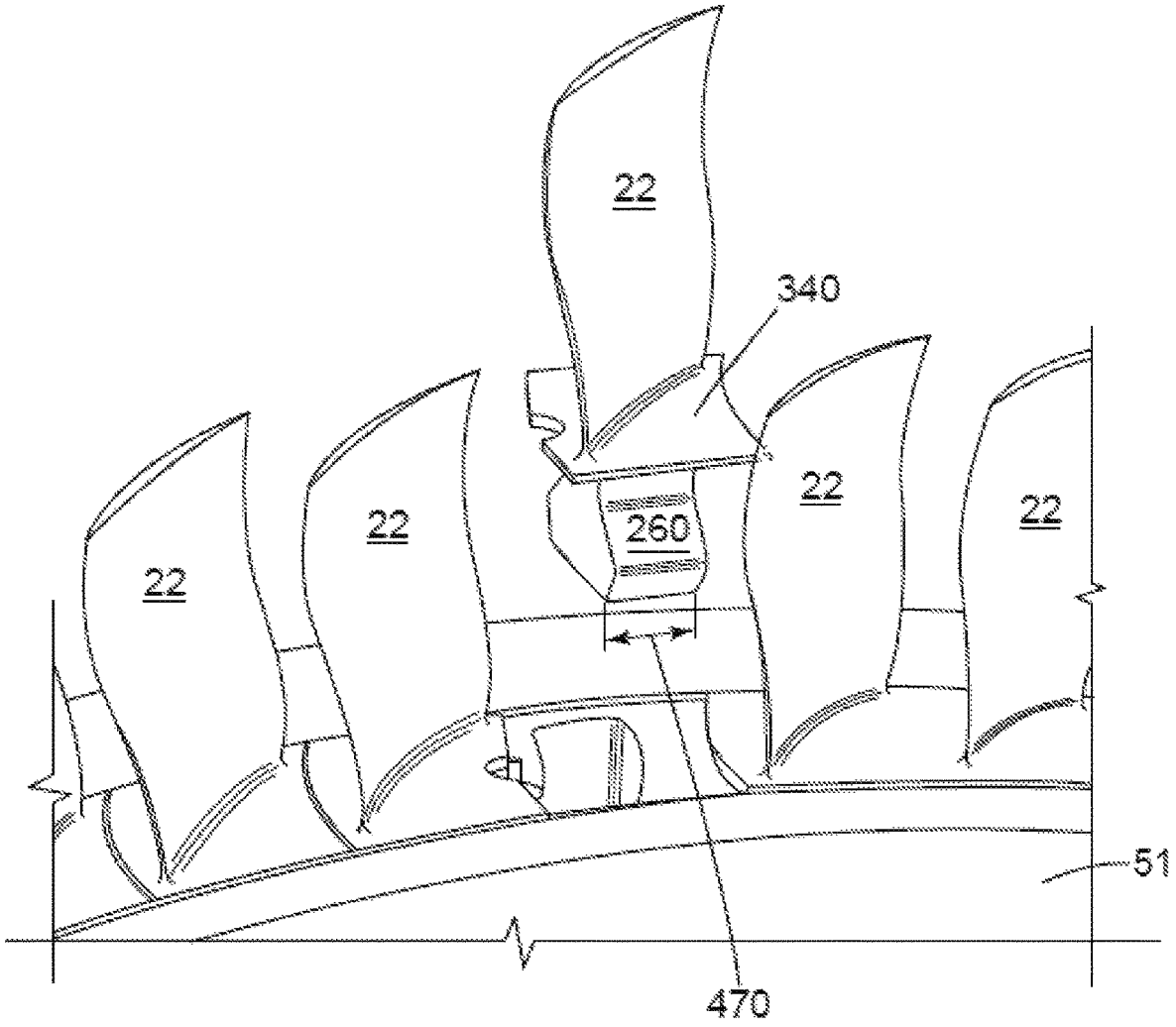
FIG. 4 is a perspective view of multiple rotor blades and a portion of a wheel slot, according to an aspect of the invention.

FIG. 4 illustrates a perspective view of a number of rotor blades 22 and a portion of rotor wheel 51, according to an aspect of the present invention. The rotor blade 22 may have a mounting base with a circumferential width 470. As further described hereinafter, the variable characteristics include, but are not limited to, the tang height 320, neck width 330, platform length 350, platform height 352 platform edge 354, platform cusp 356, platform angles 358, 359, and circumferential width 470. All these features (or characteristics) may be modified so that blades for one stage have at least one characteristic that is different from those blades designed for another stage of the compressor. For ease of explanation, a first stage and a second stage will be referred to, but it is to be understood that the "first" and "second" stages are not limited to the actual first stage of a compressor and the actual second stage of a compressor, but rather different stages of the compressor. As one non-limiting example only, the "first stage" may refer to an actual fourth stage of a compressor and the "second stage" may refer to an actual sixth stage of a compressor.

FIG. 3 shows a rotor blade 22 installed in a slot 310 in a desired stage. The various features or characteristics of the rotor blade 22 are matched by complementary characteristics of slot 310. As one example only, the platform edge 354 of the rotor blade 22 is matched by a complementary shaped and sized opening in slot 310. However, in previous known designs rotor blades for a specific stage could be installed, incorrectly, in non-desired stages. For example, a stage six rotor blade might be installed (incorrectly) in a stage seven rotor wheel. Aspects of the present invention substantially reduce, or even eliminate, the possibility of this incorrect part installation.

Figure 5:
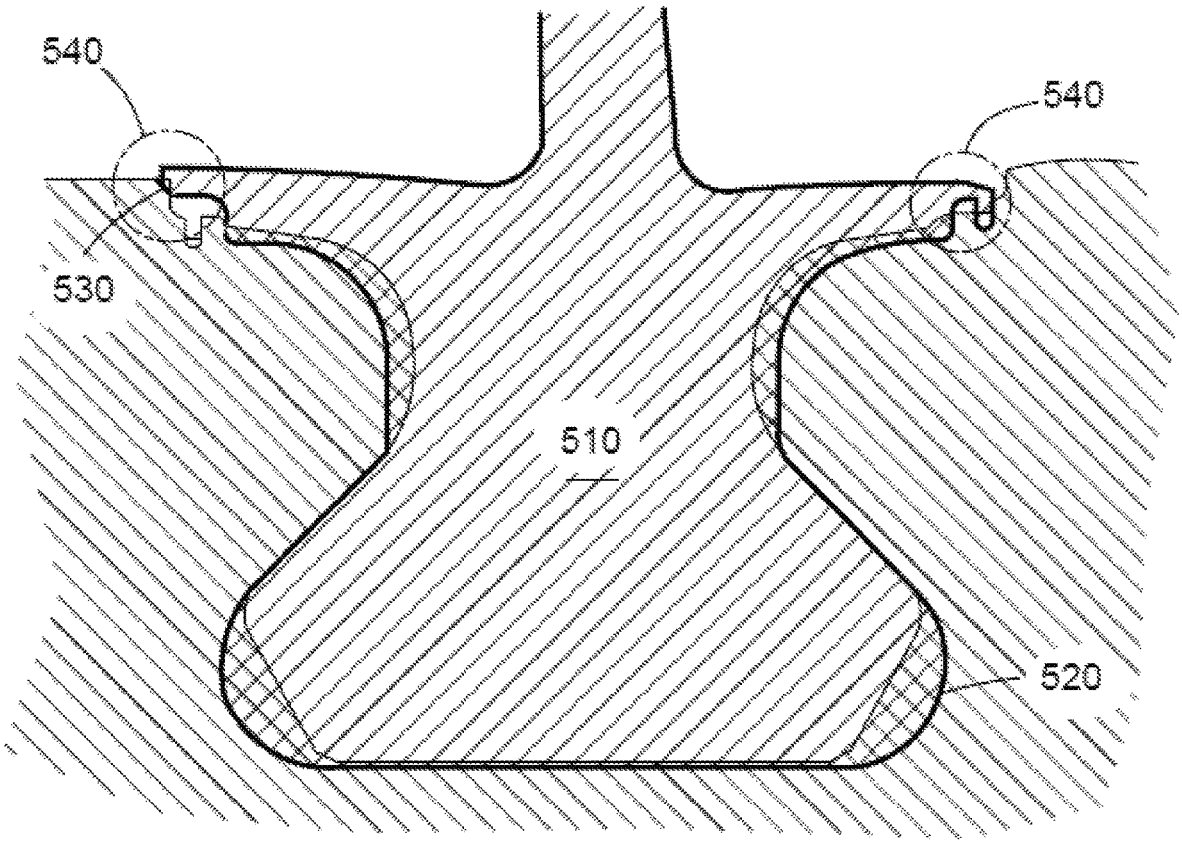
FIG. 5 is a cross-sectional view of a rotor blade mounting base and wheel slot, according to an aspect of the invention.

FIG. 5 illustrates a cross-sectional view of a rotor blade attempting to be incorrectly installed in a slot, and illustrates how the blade and slot characteristics prevent this incorrect installation. Rotor blade 510 is shown as it is about to be installed in slot 520. However, the platform edge 530, as well as, the platform length and height characteristics prevent the blade 510 from being installed in slot 520. This can be seen by the overlapping regions in circles 540, and the result is that the blade 510 can't be inserted into the slot 520, because the platform on the left side is too long and the platform on the right side is too deep (or high). The blade 510 may also be designed to have asymmetrical characteristics to prevent backwards installation. For example, if the blade 510 was rotated 180 degrees about its radial axis, then the blade 510 would fit into the designated slot 520. In this example the platform edges, heights and lengths may be asymmetric, as one side of the platform may not mirror the other side of the platform.

Figure 6:
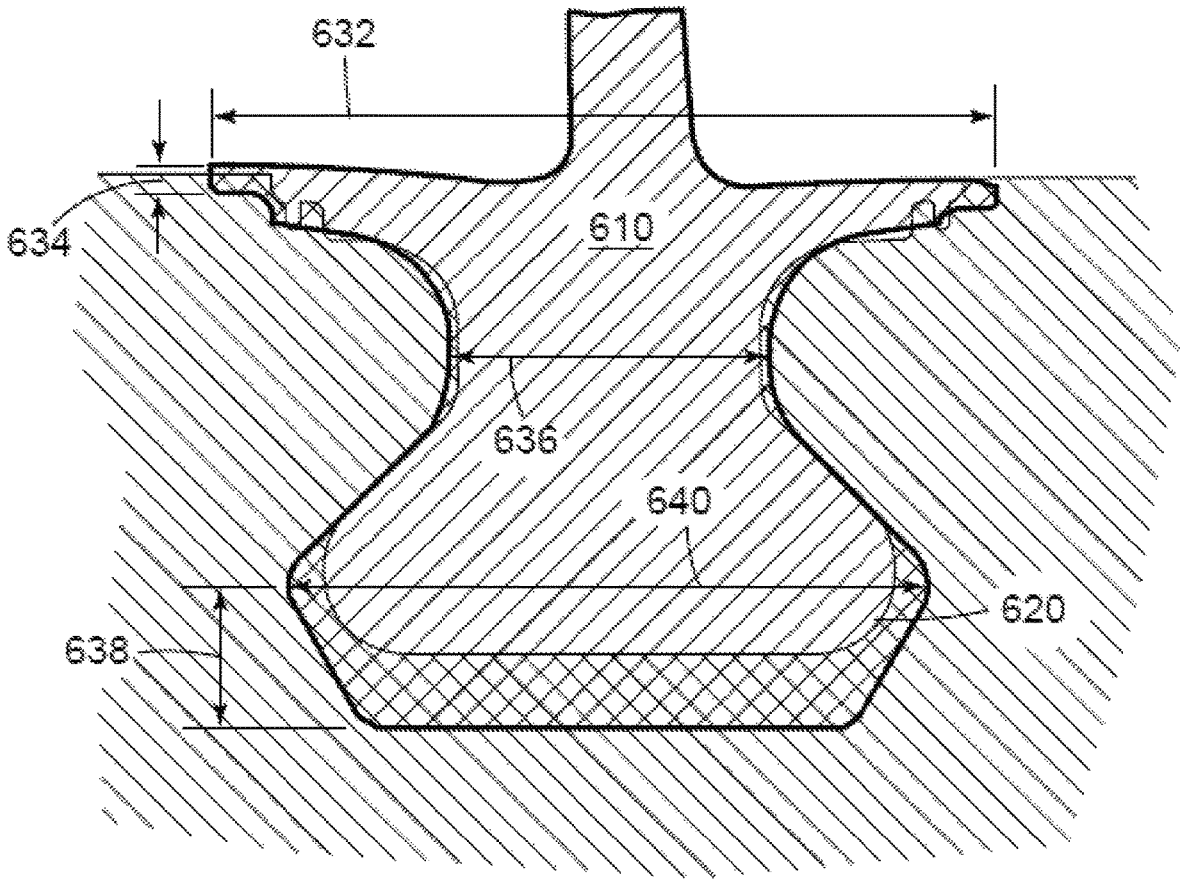
FIG. 6 is a cross-sectional view of a rotor blade mounting base and wheel slot, according to an aspect of the invention.

FIG. 6 illustrates a cross-sectional view of a rotor blade 610 having a mounting base that is too large to fit into slot 620 of a rotor wheel. The platform length 632 and platform height 634 characteristics are greater than the opening in slot 620, and these differences prevent the blade 610 from being installed in slot 620. In addition, the neck width 636 is wider than the corresponding neck width of slot 620, and the tang height 638 and tang width 640 are also greater than the corresponding slot dimensions. As one example only, blade 610 could be a stage 4 (or R4) blade and slot 620 could be a stage 6 (or R6) wheel slot.

Figure 7:
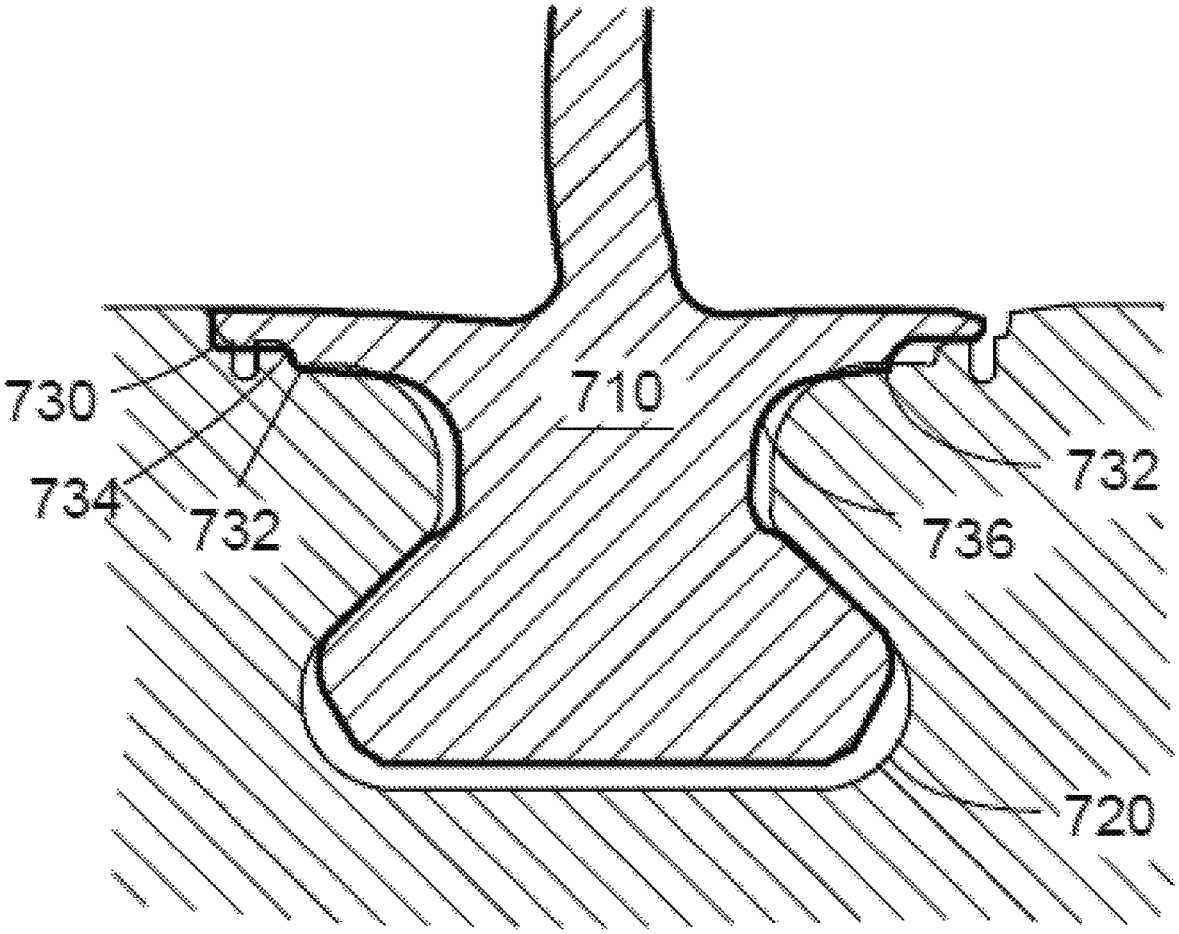
FIG. 7 is a cross-sectional view of a rotor blade mounting base and wheel slot, according to an aspect of the invention.

FIG. 7 illustrates a cross-sectional view of a rotor blade 710 and wheel slot 720. The rotor blade 710 has a platform edge 730 that is too deep (or high) to fit in the corresponding location of slot 720. The platform cusp 732 (on both sides of the platform) is also too deep to fit in slot 720. The platform angles 734 and 736 are also dimensioned so that they will interfere with the walls of slot 720.

Figure 8:
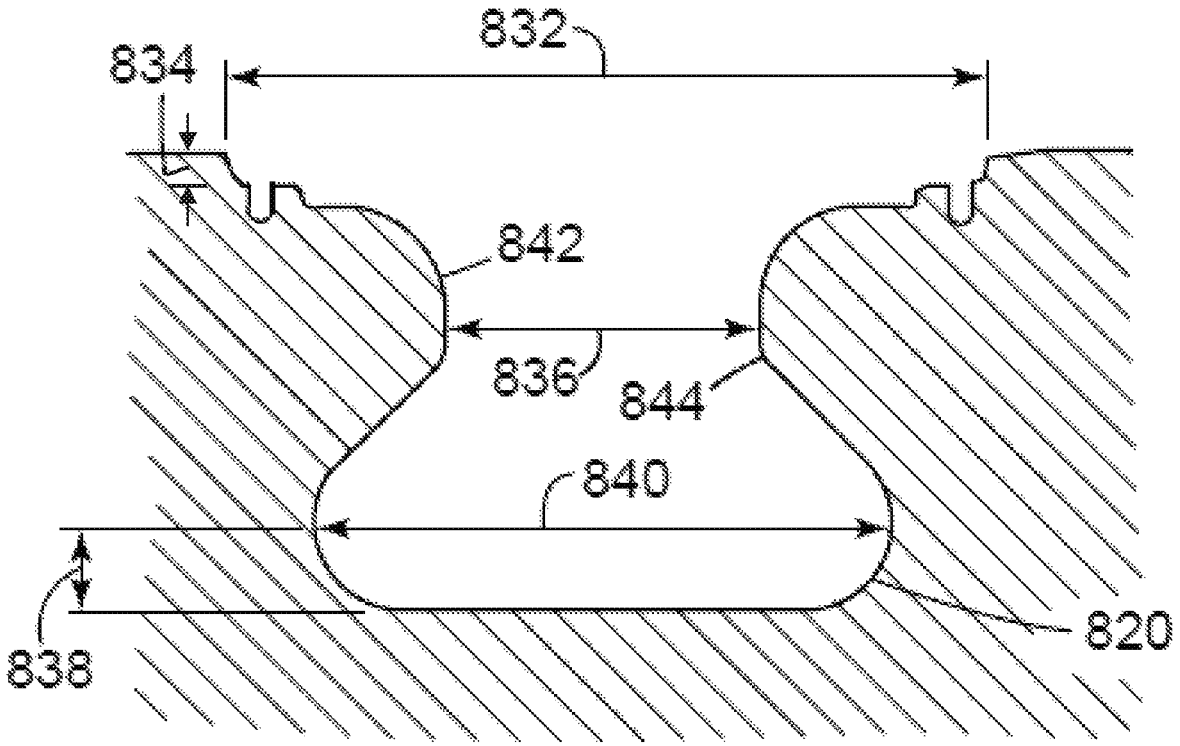
FIG. 8 is a cross-sectional view of a wheel slot, according to an aspect of the invention.

The previous description was directed to blade characteristics, but it is to be understood that the slots in the rotor wheel may also have characteristics that are modified to selectively accept only the target blade. As non-limiting examples only, and referring to FIG. 8 the slot 820 characteristics that can be modified include the slot opening width 832, platform opening depth 834, slot neck width 836, slot neck angles 842, 844 (or radius), and slot tang depth 838 and/or slot tang width 840.

The present invention provides for the modification of various blade and slot characteristics so that only the desired stage blade can be installed in the desired stage wheel slot. Further, the blade and slot characteristics can be modified so that the blade can be installed in only one orientation (to prevent backwards installation).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An apparatus, comprising:

a rotor blade comprising a mounting base configured to mount in a slot of a plurality of rotor slots in a rotor of a turbomachine, wherein the plurality of rotor slots have different geometries relative to one another, wherein the rotor blade comprises:

a blade portion;

a mounting base portion coupled to the blade portion, wherein the mounting base portion has at least one geometry matched with a corresponding geometry of the slot in the rotor and mismatched with a different geometry of a different rotor slot of the plurality of rotor slots in the rotor, and the at least one geometry comprises at least three features of a plurality of features selected from a platform width, a platform height, a platform angle, a tang height, or a circumferential width, wherein the platform width, the platform height, and the platform angle correspond to a platform geometry of a platform configured to extend into a platform recess at the slot.

2. The apparatus of claim 1, wherein the at least three features comprise at least two of: the platform width, the platform height, or the platform angle.

3. The apparatus of claim 1, wherein the at least three features comprises the circumferential width.

4. The apparatus of claim 1, wherein the at least one geometry comprises each of the platform width, the platform height, and the platform angle.

5. The apparatus of claim 1, wherein the at least one geometry comprises at least four of the platform width, the platform height, the platform angle, the tang height, or the circumferential width.

6. The apparatus of claim 1, wherein the at least one geometry comprises each of the platform width, the platform height, the platform angle, the tang height, and the circumferential width.

7. The apparatus of claim 1, comprising the turbomachine having a plurality of the rotor blades.

8. The apparatus of claim 7, wherein the turbomachine comprises a compressor, a turbine, or a combination thereof.

9. The apparatus of claim 7, wherein the slot and the different rotor slot are disposed in different stages of the turbomachine.

10. The apparatus of claim 9, wherein the turbomachine comprises at least three stages of rotor blades disposed in respective rotor slots of the plurality of rotor slots, and each stage of the at least three stages has the mounting base portion with at least one geometry matched with a corresponding geometry of the respective rotor slot and mismatched with different geometries of the remaining rotor slots of the plurality of rotor slots.

11. The apparatus of claim 1, wherein the slot and the different slot of the plurality of rotor slots are different stages downstream from a first stage of the turbomachine.

12. The apparatus of claim 1, wherein the slot and the different slot of the plurality of rotor slots are oriented in a common slot direction relative to a longitudinal axis of the turbomachine.

13. The apparatus of claim 12, wherein the common slot direction is a circumferential slot direction about the longitudinal axis of the turbomachine.

14. An apparatus, comprising:

a rotor comprising a plurality of rotor slots configured to support a plurality of mounting base portions of a plurality of rotor blades of a turbomachine, wherein the plurality of rotor slots have different geometries relative to one another, wherein a slot of the plurality of rotor slots is configured to support a mounting base portion of a rotor blade of the plurality of rotor blades of the turbomachine, wherein the slot has at least one geometry matched with a corresponding geometry of the mounting base portion of the rotor blade of the plurality of rotor blades and mismatched with a different geometry of a different mounting base portion of another rotor blade of the plurality of rotor blades, and the at least one geometry comprises at least three features of a plurality of features selected from a platform recess width, a platform recess depth, a platform recess angle, a slot opening width, a slot neck angle, a slot tang depth, or a slot tang width, wherein the platform recess width, the platform recess depth, and the platform recess angle correspond to a platform recess geometry of a platform recess configured to receive a platform of the mounting base portion of the rotor blade.

15. The apparatus of claim 14, wherein the at least three features comprise at least two of: the slot opening width, the slot neck angle, the slot tang depth, or the slot tang width.

16. The apparatus of claim 14, wherein the at least one geometry comprises each of the platform recess width, the platform recess depth, and the platform recess angle.

17. The apparatus of claim 14, wherein the turbomachine comprises at least three stages of rotor blades of the plurality of rotor blades disposed in respective rotor slots of the plurality of rotor slots, and each stage of the at least three stages has the mounting base portion with at least one geometry matched with a corresponding geometry of the respective rotor slot of the plurality of rotor slots and mismatched with different geometries of the remaining rotor slots of the plurality of rotor slots.

18. The apparatus of claim 14, wherein the at least one geometry comprises at least four of the platform recess width, the platform recess depth, the platform recess angle, the slot opening width, the slot neck angle, the slot tang depth, or the slot tang width.

19. The apparatus of claim 14, comprising the turbomachine having the rotor with a plurality of stages, wherein the slot supporting the mounting base portion of the rotor blade is disposed in a different stage than another slot supporting the different mounting base portion of the other rotor blade.

20. An apparatus, comprising:

a turbomachine, comprising:

a rotor having a plurality of rotor slots, wherein the plurality of rotor slots have different geometries relative to one another; and at least three stages of rotor blades of a plurality of rotor blades disposed in respective rotor slots of the plurality of rotor slots, wherein each rotor blade of the plurality of rotor blades has a blade portion coupled to a mounting base portion configured to mount in one of the plurality of rotor slots, wherein at least one rotor blade of the plurality of rotor blades in each stage of the at least three stages has the mounting base portion with at least one geometry matched with a corresponding geometry of the rotor slot in the respective stage and mismatched with different geometries of the remaining rotor slots of the plurality of rotor slots in the at least three stages, wherein the at least one geometry comprises at least one of: a platform geometry of a platform configured to extend into a platform recess at the rotor slot, a tang height, or a circumferential width.

21. The apparatus of claim 20, wherein the platform geometry comprises at least one of a platform width, a platform height, or a platform angle.

22. The apparatus of claim 21, wherein the at least one geometry comprises at least three of the platform width, the platform height, the platform angle, the tang height, or the circumferential width.

* * * * *